US009413117B2

(12) United States Patent
Hsu

(10) Patent No.: US 9,413,117 B2
(45) Date of Patent: Aug. 9, 2016

(54) RECEPTACLE

(71) Applicant: Yong Tai Electronic(DONGGUAN) Ltd., Dongguan (CN)

(72) Inventor: Ching-Jen Hsu, Dongguan (CN)

(73) Assignee: YONG TAI ELECTRONIC(DONGGUAN) LTD., Dongguan (CN)

( * ) Notice: Subject to any disclaimer, the term of this patent is extended or adjusted under 35 U.S.C. 154(b) by 0 days.

(21) Appl. No.: 14/834,522

(22) Filed: Aug. 25, 2015

(65) Prior Publication Data

US 2016/0149346 A1 May 26, 2016

(30) Foreign Application Priority Data

Nov. 24, 2014 (CN) ..... 2014 1 0680687
Nov. 24, 2014 (CN) ..... 2014 1 0683205

(51) Int. Cl.
*H01R 13/6594* (2011.01)
*H01R 13/6581* (2011.01)
*H01R 13/66* (2006.01)

(52) U.S. Cl.
CPC ..... *H01R 13/6581* (2013.01); *H01R 13/665* (2013.01)

(58) Field of Classification Search
CPC ..... H01R 13/6581; H01R 13/665
USPC ..... 439/607.35, 607.4, 607.01, 607.36
See application file for complete search history.

(56) References Cited

U.S. PATENT DOCUMENTS 6,093,057 A * 7/2000 Lok ..... H01R 13/6275 439/353
6,558,183 B1 * 5/2003 Ji ..... H01R 13/6275 439/358
6,991,487 B2 * 1/2006 Wu ..... H01R 13/6275 439/355
7,128,588 B2 * 10/2006 Hu ..... H01R 13/6275 439/159
7,374,463 B2 * 5/2008 Kuo ..... H01R 13/506 439/607.01
7,607,947 B1 * 10/2009 Ho ..... H01R 12/707 439/108
RE43,780 E * 10/2012 Kubota ..... H01R 13/629 439/607.36
8,450,620 B2 * 5/2013 Cai ..... H01R 12/721 174/250
8,764,484 B2 * 7/2014 Zhang ..... H01R 13/6598 439/607.36
8,870,606 B2 * 10/2014 Yu ..... H01R 9/031 439/701
2013/0267117 A1 * 10/2013 Hsu ..... H01R 13/5213 439/607.01
2015/0244110 A1 * 8/2015 Ju ..... H01R 13/6585 439/607.01
2016/0064879 A1 * 3/2016 Yen ..... H01R 24/78 439/607.01
2016/0072208 A1 * 3/2016 Li ..... H01R 12/7047 439/78
2016/0141803 A1 * 5/2016 Hsu ..... H01R 13/6581 439/607.55
2016/0141805 A1 * 5/2016 Zhao ..... H01R 13/6581 439/607.01
2016/0141806 A1 * 5/2016 Guo ..... H01R 13/6581 439/607.01
2016/0149346 A1 * 5/2016 Hsu ..... H01R 13/665 439/607.01

* cited by examiner

*Primary Examiner* — Abdullah Riyami
*Assistant Examiner* — Nelson R Burgos-Guntin
(74) *Attorney, Agent, or Firm* — WPAT, PC; Justin King

(57) ABSTRACT

A receptacle comprises a tongue, a plurality of top contacts, a grounding piece and a conductive shell. The tongue is integrated into a printed circuit board. The top contacts are spaced apart along a top row on the tongue and include a pair of top grounding contacts respectively located at both sides of the top row. The grounding piece sequentially has a tail mounted onto the printed circuit board, a base attached to a rear portion of the tongue, a top shielding pad located behind the top contacts and two arms respectively constituting both sides of the tongue. The grounding contacts are respectively located on top surfaces of the two arms. The conductive shell is coupled to the base and surrounds the tongue and the grounding piece.

20 Claims, 8 Drawing Sheets

RECEPTACLE

CROSS-REFERENCE TO RELATED APPLICATIONS

The present application claims the benefit of priority to Chinese patent application No. 201410683205.4, filed Nov. 24, 2014 and entitled "Electrical Connector Assembly and the Method of Manufacturing it" as well as Chinese patent application No. 201410680687.8, filed Nov. 24, 2014 and entitled "Receptacle Connector", the disclosures of which are hereby incorporated by reference in their entirety.

FIELD OF THE INVENTION

The present invention generally relates to a connector, and more particularly to a receptacle having a tongue and a grounding piece.

BACKGROUND OF THE INVENTION

Universal Serial Bus (USB) interfaces are commonly used in a variety of applications for connecting two electronic devices. The design of USB is standardized by the USB Implementers Forum (USB-IF), which has released a USB Type C Specification on Aug. 11, 2014 in order to meet requirements of high-speed, miniaturization and high-capacity. Under the circumstances, connectors with high frequency, compact design and excellent reliability are craved.

SUMMARY OF THE PRESENT INVENTION

According to the present invention, a receptacle with high frequency, compact design and excellent reliability is provided.

To achieve the above objectives, one particular embodiment of the invention pertains to a receptacle comprising a printed circuit board, a plurality of top contacts, a grounding piece and a conductive shell. A tongue is integrated into the printed circuit board. The plurality of top contacts are spaced apart along a top row on a top surface of the tongue. The plurality of top contacts include a pair of top grounding contacts, wherein the pair of top grounding contacts are respectively located at both sides of the top row. The grounding piece sequentially has a tail, a base, a top shielding pad and two arms. The tail is mounted onto the printed circuit board. The base is attached to a rear portion of the tongue. The top shielding pad is located behind the plurality of top contacts and protrudes from the top surface of the tongue. The two arms respectively constitute both sides of the tongue. The pair of top grounding contacts are respectively located on top surfaces of the two arms, wherein the plurality of top contacts excepting the pair of top grounding contacts are electrically isolated from the grounding piece. The conductive shell has a wall. The wall surrounds the tongue and the grounding piece. A rear portion of the wall is coupled to the base of the grounding piece, wherein a mating port configured to receive the plug is formed from a space between the wall and the tongue and a top gap between the wall and the top shielding pad.

Other objects, advantages and novel features of the invention will become readily apparent from the following detailed description when taken in conjunction with the accompanying drawings.

DETAILED DESCRIPTION OF THE INVENTION

The present invention will now be described in detail with reference to an embodiment thereof as illustrated in the accompanying drawings.

Figure 1:
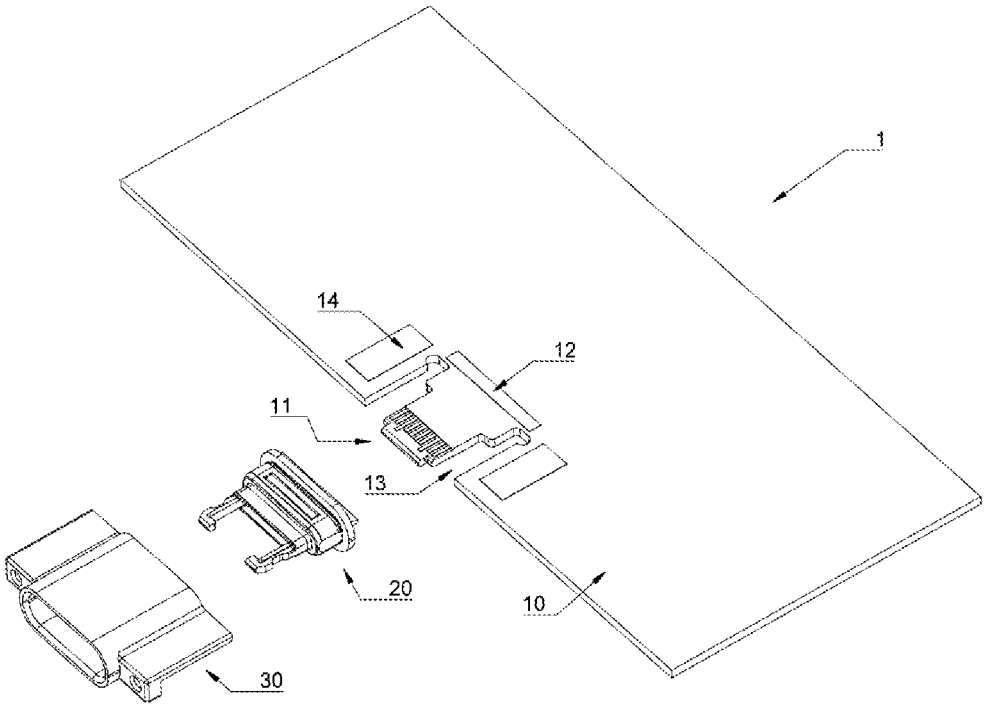
FIG. 1 is an exploded view of a receptacle 1 according to one embodiment of the present invention.
Figure 2:
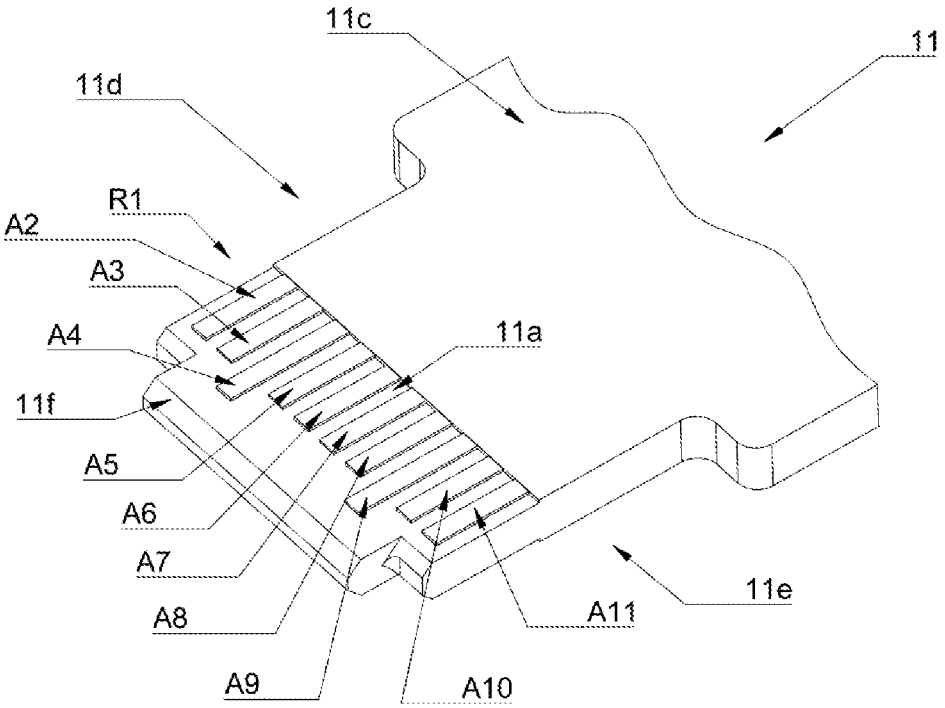
FIG. 2 is a perspective view of the tongue 11 shown in FIG. 1 according to one embodiment of the present invention.
Figure 3:
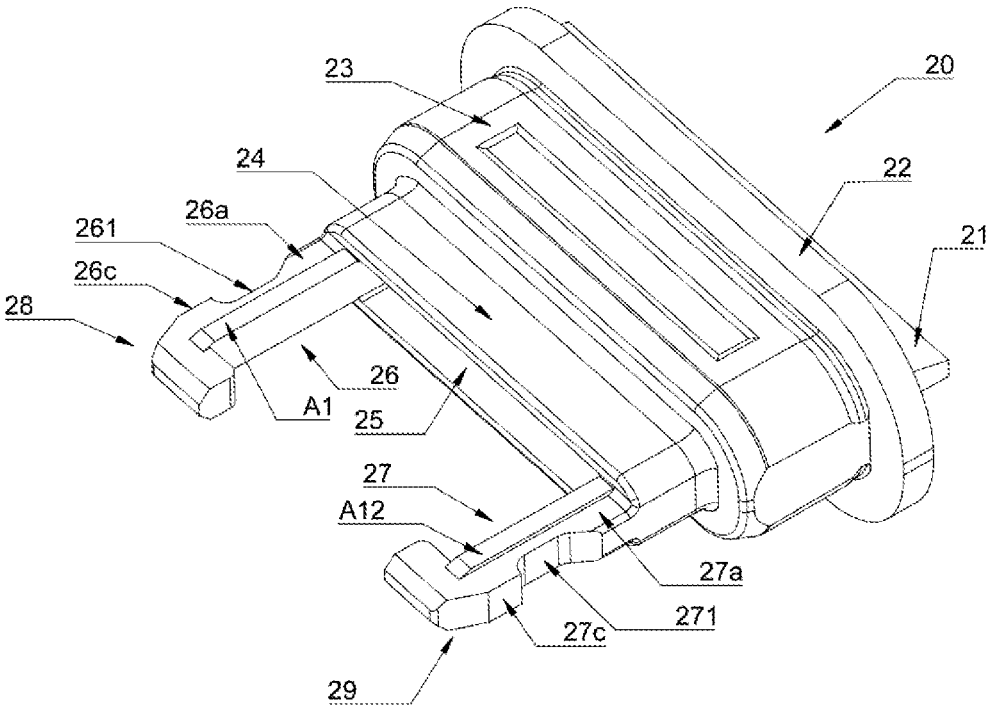
FIG. 3 is a perspective view of the grounding piece 20 shown in FIG. 1 according to one embodiment of the present invention.

In order to better appreciate and understand the present invention, reference is first made to FIGS. 1-3, which are an exploded view of a receptacle 1 and both perspective views of a tongue 11 and a grounding piece 20, respectively, according to one embodiment of the present invention. The receptacle 1 is provided for electrically mating a plug (not shown) and comprises a printed circuit board 10, the grounding piece 20 and a conductive shell 30. The tongue 11 is integrated into the printed circuit board 10.

The receptacle 1 further comprises a plurality of top contacts A1~12 and a plurality of bottom contacts B1~12 (not shown). The plurality of top contacts A1~12 are spaced apart along a top row R1 on a top surface 11*a* of the tongue 11. The plurality of top contacts A1~12 include a pair of top grounding contacts A1 & A12. The pair of top grounding contacts A1 & A12 will be respectively located at both sides of the top row R1 when a base 23 of the grounding piece 20 is attached to a rear portion 11*c* of the tongue 11. Similarly, the plurality of bottom contacts B1~12 are spaced apart along a bottom row R2 (not shown) on a bottom surface 11*b* (not shown) of the tongue 11, wherein the bottom surface 11*b* of the tongue 11 is opposite to the top surface 11*a* of the tongue 11 while the bottom row R2 is right below the top row R1. The plurality of bottom contacts B1~12 include a pair of bottom grounding contacts B1 & B12. The pair of bottom grounding contacts B1 & B12 will be respectively located at both sides of the bottom row R2 when the base 23 of the grounding piece 20 is attached to the rear portion 11*c* of the tongue 11.

The grounding piece 20 sequentially has a tail 21, a flange 22, the base 23, a top shielding pad 24, a bottom shielding pad 25, two arms 26 & 27 and two extensions 28 & 29. The tail 21 is suitable for being soldered to a rear pad 12, or otherwise mounted onto the printed circuit board 10. The flange 22 between the tail 21 and the base 23 engages the printed circuit board 10. The base 23 is attached to the rear portion 11*c* of the tongue 11. The top shielding pad 24 is located behind the plurality of top contacts A1~12 and protrudes from the top surface 11*a* of the tongue 11. The bottom shielding pad 25 is located behind the plurality of bottom contacts B1~12 and protrudes from the bottom surface 11*b* of the tongue 11. The two arms 26 & 27 will respectively constitute both sides 11*d* & 11*e* of the tongue 11 if the base 23 is attached to the rear portion 11*c* of the tongue 11. The two extensions 28 & 29 respectively extend from the two arms 26 & 27 transversally. The two extensions 28 & 29 will respectively constitute a front edge 11*f* of the tongue 11 as the base 23 is attached to the rear portion 11*c* of the tongue 11. In other embodiments, the two extensions may merge together to form the front edge 11*f* of the tongue 11. It is worthwhile mentioning that the grounding piece 20 can be made from die casing zinc alloy so that each part of the grounding piece 20 is seamlessly integrated into one piece. Consequently, both the pair of top grounding contacts A1 & A12 and the pair of bottom grounding contacts B1 & B12 can be well connected together within the grounding piece 20.

The plurality of top contacts A1~12 excepting the pair of top grounding contacts A1 & A12 are electrically isolated from the grounding piece 20. Particularly, the pair of top grounding contacts A1 & A12 are respectively located on top surfaces 26*a* & 27*a* of the two arms 26 & 27. Furthermore, the pair of top grounding contacts A1 & A12 even respectively protrude from the top surfaces 26*a* & 27*a* of the two arms 26 & 27. Correspondingly, the plurality of bottom contacts B1~12 excepting the pair of bottom grounding contacts B1 & B12 are electrically isolated from the grounding piece 20. Specifically, the pair of bottom grounding contacts B1 & B12 are respectively located on bottom surfaces 26*b* & 27*b* (not show) of the two arms 26 & 27. Moreover, the pair of bottom grounding contacts B1 & B12 further respectively protrude from the bottom surfaces 26*b* & 27*b* of the two arms 26 & 27.

The plurality of top contacts A1~12 excepting the pair of top grounding contacts A1 & A12 are directly printed on the top surface 11*a* of the tongue 11. The pair of top grounding contacts A1 & A12 respectively have a width equal to that of the other top contacts A2~11. Nonetheless, the pair of top grounding contacts A1 & A12 may have a width bigger than that of the other top contacts A2~11 in other embodiments. Correspondingly, the plurality of bottom contacts B1~12 excepting the pair of bottom grounding contacts B1 & B12 also are directly printed on the bottom surface 11*b* of the tongue 11. The pair of bottom grounding contacts B1 & B12 also have a width equal to that of the other bottom contacts B2~11. Nevertheless, the pair of bottom grounding contacts B1 & B12 can have a width bigger than that of the other bottom contacts B2~11 in some embodiments. Also noteworthy is that both the pair of top grounding contacts A1 & A12 and the pair of bottom grounding contacts B1 & B12 can have a length equal to or bigger than that possessed by the rest of top contacts A2~11 and bottom contacts B2~11 according to embodiments of the present invention.

Two retainers 261 & 271 are respectively arranged at lateral surfaces 26*c* & 27*c* of the two arms 26 & 27, wherein the two retainers 261 & 271 are adapted to engage with two corresponding counter retainers (not shown) on the plug. The two retainers 261 & 271 can respectively formed on the lateral surfaces 26*c* & 27*c* of the two arms 26 & 27. For example, the two retainers 261 & 271 include, but are not limited to, angled indentations or notches formed on the lateral surfaces 26*c* & 27*c*. In contrast, the two corresponding counter retainers on the plug are, for example, two side latches.

Figure 4:
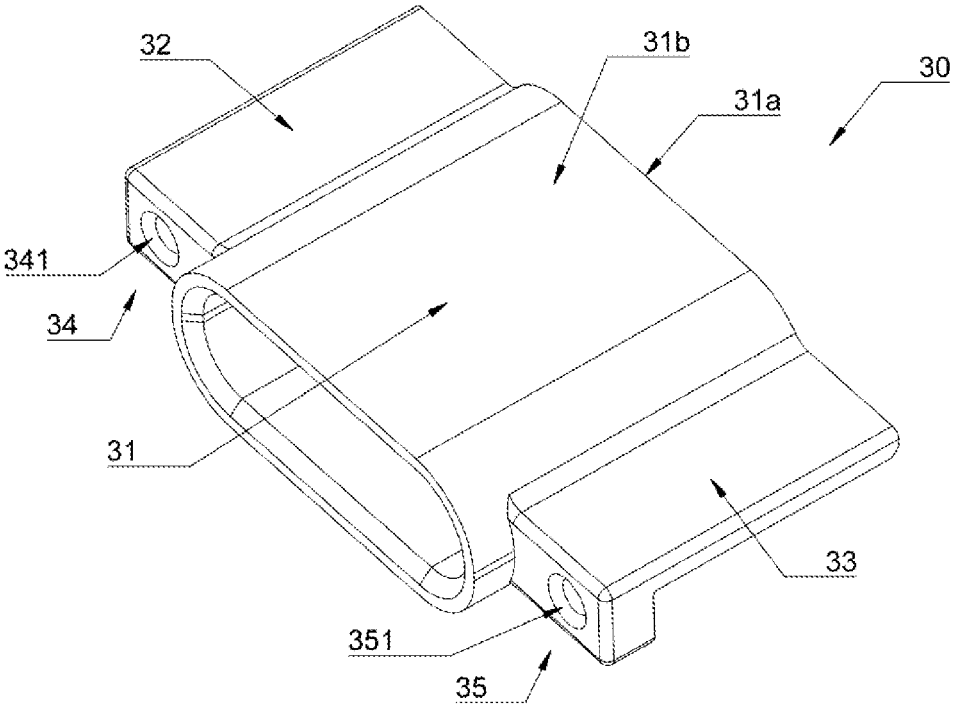
FIG. 4 is a perspective view of the conductive shell 30 shown in FIG. 1 according to one embodiment of the present invention.

Reference is now made to FIG. 1 as well as FIG. 4, which is a perspective view of the conductive shell 30 shown in FIG. 1 according to one embodiment of the present invention. The conductive shell 30 has a wall 31, two lateral wings 32 & 33 and two positioning blocks 34 & 35. The wall 31 surrounds the tongue 11 and the grounding piece 20. A rear edge 31*a* of the wall 31 engages the flange 22 of the grounding piece 20. A rear portion 31*b* of the wall 31 is coupled to the base 23 of the grounding piece 20. The two lateral wings 32 & 33 respectively extend from both sides of the wall 31 and span two slots 13 between the tongue 11 and the printed circuit board 10. The two lateral wings 32 & 33 are suitable for being soldered to two lateral pads 14 adjacent to the two slots 13 and, therefore, mounting the conductive shell 30 onto the printed circuit board 10. The two positioning blocks 34 & 35 respectively extend from the two lateral wings 32 & 33 downward. Furthermore, the two positioning blocks 34 & 35 respectively have holes 341 & 351 for fastening the conductive shell 30. As can be expected, the conductive shell 30 also can be made from zinc alloy by die casting into one piece. Therefore, both the base 23 of the grounding piece 20 and the wall 31 of the conductive shell 30 can be seamless. As a result of this, electromagnetic interference effects can be reduced while electromagnetic compatibility can be improved to meet shielding effectiveness requirements and ensure better high-frequency characteristics.

Figure 5:
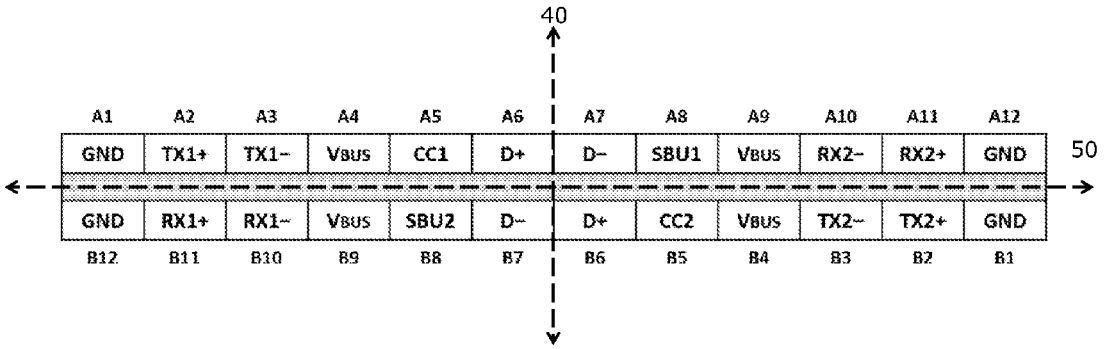
FIG. 5 is a schematic front view of the tongue 11 shown in FIG. 1 in accordance with the USB Type C Specification.

Reference is then made to FIG. 5, which is a schematic front view of the tongue 11 shown in FIG. 1 in accordance with the USB Type C Specification. The plurality of top contacts A1~12 and the plurality of bottom contacts B1~12 are in a diagonal relationship to each other regarding pin assignments. That is, the plurality of top contacts A1~12 are in a cater-cornered relationship to the plurality of bottom contacts B1~12 across a center plane 40 that bisects the receptacle 1 along a length of the tongue 11. However, the pin assignments may alternatively comply with other specifications in other embodiments.

Figure 6:
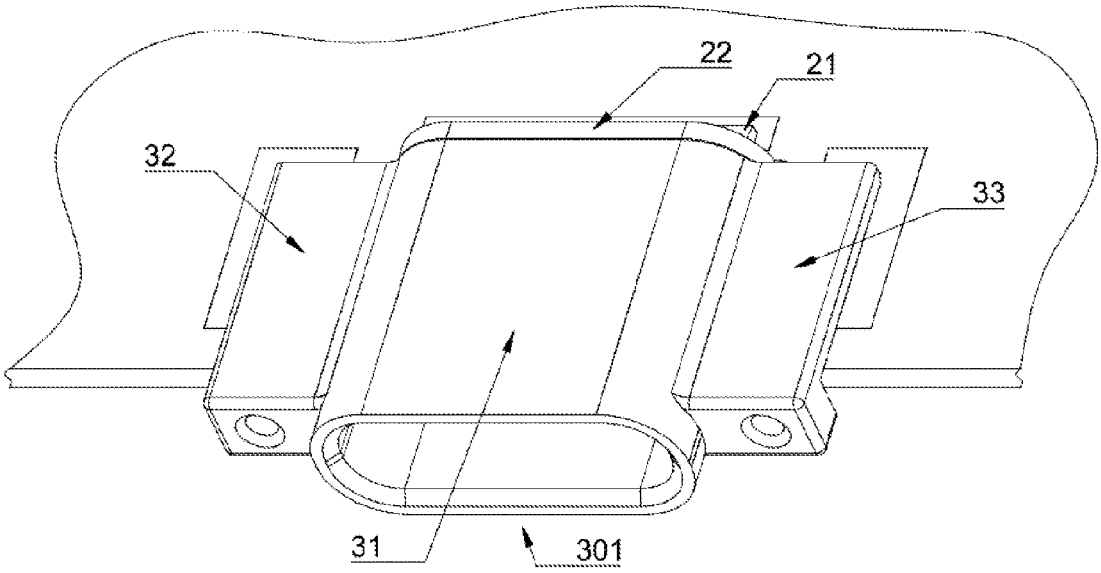
FIG. 6 is a perspective view of the receptacle 1 according to one embodiment of the present invention.
Figure 7:
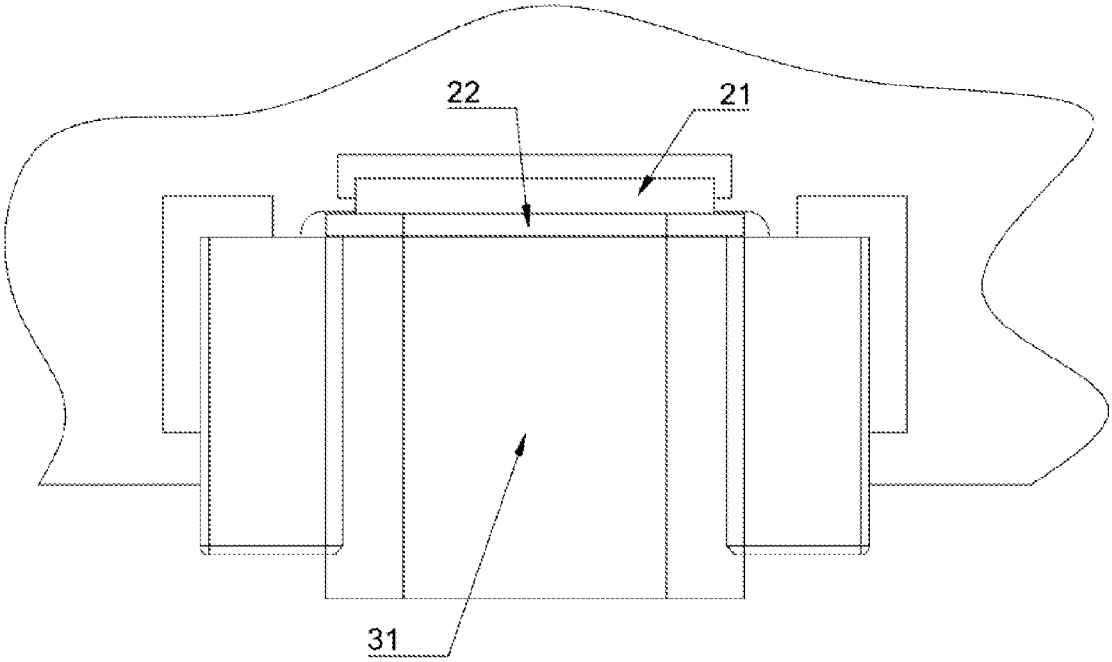
FIG. 7 is a front view of the receptacle 1 according to one embodiment of the present invention.
Figure 8:
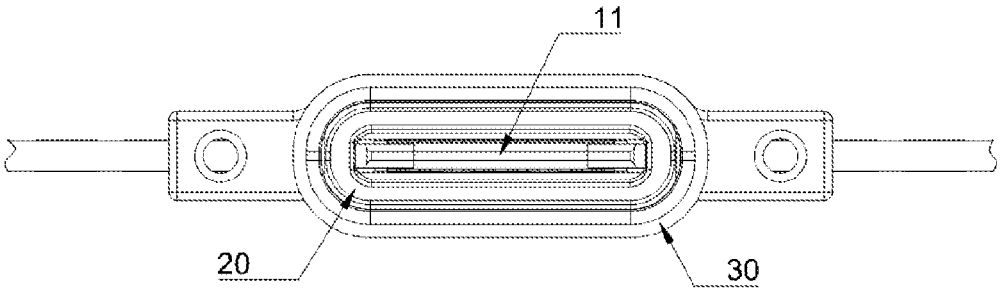
FIG. 8 is a bottom view of the receptacle 1 according to one embodiment of the present invention.

Reference is last made to FIGS. 6-8, which are perspective, front and bottom views, respectively, of the receptacle 1 according to one embodiment of the present invention. Morphology of the tongue 11, the grounding piece 20 and the conductive shell 30 are substantially symmetrical with respect to the center plane 40. A mating port 301 is configured to receive the plug. The mating port 301 is formed from a space 301*a*(not shown) between the wall 31 and the tongue 11 and a top gap 301*b* (not shown) between the wall 31 and the top shielding pad 24 and a bottom gap 301*c* (not shown) between the wall 31 and the bottom shielding pad 25. Moreover, the mating port 301 is substantially symmetrical with respect to the center plane 40 and another plane 50 in FIG. 5. Thus the plug can be inserted into the receptacle 1 in dual orientations.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A receptacle for electrically mating a plug, comprising:

a printed circuit board into which a tongue is integrated;

a plurality of top contacts spaced apart along a top row on a top surface of the tongue, the plurality of top contacts including a pair of top grounding contacts, wherein the pair of top grounding contacts are respectively located at both sides of the top row;

a grounding piece sequentially having a tail, a base, a top shielding pad and two arms, the tail mounted onto the printed circuit board, the base attached to a rear portion of the tongue, the top shielding pad located behind the plurality of top contacts and protruding from the top surface of the tongue, the two arms respectively constituting both sides of the tongue, the pair of top grounding contacts respectively located on top surfaces of the two arms, wherein the plurality of top contacts excepting the pair of top grounding contacts are electrically isolated from the grounding piece; and a conductive shell having a wall, the wall surrounding the tongue and the grounding piece, a rear portion of the wall coupled to the base of the grounding piece, wherein a mating port configured to receive the plug is formed from a space between the wall and the tongue and a top gap between the wall and the top shielding pad.

2. The receptacle set forth in claim 1 wherein the grounding piece further comprises two extensions respectively extending from the two arms to constitute the front edge of the tongue.

3. The receptacle set forth in claim 2 wherein the two extensions merge together to form the front edge of the tongue.

4. The receptacle set forth in claim 1 wherein two retainers are respectively arranged at lateral surfaces of the two arms, the two retainers adapted to engage with two corresponding counter retainers on the plug.

5. The receptacle set forth in claim 4 wherein the two retainers include angled indentations or notches respectively formed on the lateral surfaces of the two arms.

6. The receptacle set forth in claim 1 wherein the pair of top grounding contacts respectively protrude from the top surfaces of the two arms.

7. The receptacle set forth in claim 1 wherein the pair of top grounding contacts have a width or a length equal to or bigger than that of the other top contacts.

8. The receptacle set forth in claim 1 wherein the plurality of top contacts excepting the pair of top grounding contacts are directly printed on the top surface of the tongue.

9. The receptacle set forth in claim 1 wherein the grounding piece further comprises a flange between the tail and the base, the flange engaging the printed circuit board, a rear edge of the wall engaging the flange.

10. The receptacle set forth in claim 1 wherein both the base of the grounding piece and the wall of the conductive shell are seamless.

11. The receptacle set forth in claim 1 wherein the conductive shell further has two lateral wings, the two lateral wings extending from both sides of the wall, both the tail of the grounding piece and the two lateral wings of the conductive shell being suitable for soldering.

12. The receptacle set forth in claim 11 wherein the conductive shell further comprises two positioning blocks respectively extending from the two lateral wings.

13. The receptacle set forth in claim 12 wherein the two positioning blocks respectively have a hole for fastening the conductive shell.

14. The receptacle set forth in claim 1 wherein both morphology of the conductive shell and the grounding piece are substantially symmetrical with respect to a center plane that bisects the receptacle along a length of the tongue.

15. The receptacle set forth in claim 1, further comprising a plurality of bottom contacts spaced apart along a bottom row on a bottom surface of the tongue, the bottom surface of the tongue being opposite to the top surface of the tongue, the plurality of bottom contacts including a pair of bottom grounding contacts respectively located at both sides of the bottom row, the pair of bottom grounding contacts respectively located on bottom surfaces of the two arms, wherein the plurality of bottom contacts excepting the pair of bottom grounding contacts are electrically isolated from the grounding piece.

16. The receptacle set forth in claim 15 wherein the pair of bottom grounding contacts respectively protrude from the bottom surfaces of the two arms.

17. The receptacle set forth in claim 15 wherein the pair of bottom grounding contacts have a width or a length equal to or bigger than that of the other bottom contacts.

18. The receptacle set forth in claim 15 wherein the plurality of bottom contacts excepting the pair of bottom grounding contacts are directly printed on the bottom surface of the tongue.

19. The receptacle set forth in claim 15 wherein the grounding piece further comprises a bottom shielding pad located behind the plurality of bottom contacts and protruding from the bottom surface of the tongue.

20. The receptacle set forth in claim 19 wherein the mating port also includes a bottom gap between the wall and the bottom shielding pad.

* * * * *